US008454355B2

(12) United States Patent
Tsai et al.

(10) Patent No.: US 8,454,355 B2
(45) Date of Patent: Jun. 4, 2013

(54) POROUS-MEDIUM BURNING APPARATUS

(75) Inventors: Yu-Ching Tsai, Pingtung County (TW); Tzu-Hsiang Yen, Tainan County (TW); Wen-Tang Hong, Nantou County (TW); Cheng-Nan Huang, Taoyuan County (TW); Hung-Yu Wang, Taipei County (TW); Wei-Ping Huang, Taoyuan County (TW); Chien-Hsiung Lee, Taoyuan County (TW)

(73) Assignee: Atomic Energy Council—Institute of Nuclear Energy Research, Lungtan, Taoyuan (TW)

( * ) Notice: Subject to any disclaimer, the term of this patent is extended or adjusted under 35 U.S.C. 154(b) by 718 days.

(21) Appl. No.: 12/720,531

(22) Filed: Mar. 9, 2010

(65) Prior Publication Data

US 2011/0097646 A1 Apr. 28, 2011

(30) Foreign Application Priority Data

Oct. 22, 2009 (TW) ..... 98135727 A

(51) Int. Cl.
*F23D 14/12* (2006.01)

(52) U.S. Cl.
USPC ..... 431/328; 431/170; 431/159; 431/326; 429/505; 422/232

(58) Field of Classification Search
USPC ..... 431/170, 328, 159, 326, 327, 346, 431/263; 429/505; 422/232
See application file for complete search history.

(56) References Cited

U.S. PATENT DOCUMENTS

| | | | | |
|---|---|---|---|---|
| 5,141,432 | A * | 8/1992 | Bell et al. | 431/7 |
| 5,160,254 | A * | 11/1992 | Bell et al. | 431/7 |
| 5,431,017 | A * | 7/1995 | Kobayashi et al. | 60/723 |
| 2001/0046649 | A1 * | 11/2001 | Schutz et al. | 431/4 |
| 2004/0096391 | A1 * | 5/2004 | Franz et al. | 423/650 |

* cited by examiner

*Primary Examiner* — Avinash Savani
(74) *Attorney, Agent, or Firm* — Jackson IPG PLLC

(57) ABSTRACT

A burning device is provided for fuel cell to be run under high temperature. The burning device uses a specific-designed fuel spraying device having porous medium. The burning device can be used under different statuses of flow in the fuel cell. With the burning device, the fuel cell has improved efficiency by enhancing recycling of system heat and pollution of discharged waste gas is reduced.

15 Claims, 2 Drawing Sheets

POROUS-MEDIUM BURNING APPARATUS

CROSS REFERENCE TO RELATED PATENT APPLICATIONS

Figure 1:
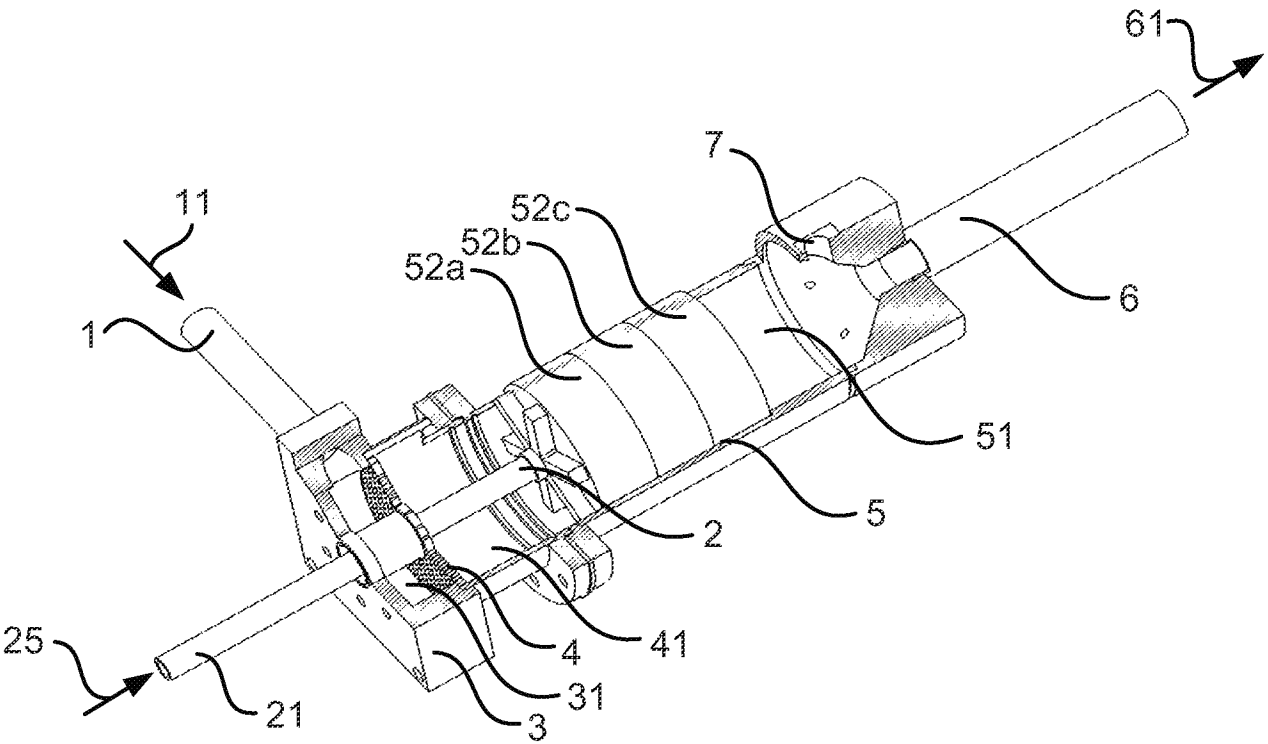

This application claims priority from Taiwan Patent Application No. 098135727, filed in the Taiwan Patent Office on Oct. 22, 2009, entitled "Porous-Medium Burning Apparatus," and incorporates the Taiwan patent application in its entirety by reference.

TECHNICAL FIELD

The present disclosure relates to a burning device; more particularly, relates to a burning apparatus providing a heat source for warming up a fuel cell system or for burning residual fuel in a tail gas of the fuel cell system, where the burning apparatus has a special designed fuel spraying device for wide application with low pollution.

DESCRIPTION OF THE RELATED ARTS

Power generating technologies related to fuel cells are widely developed today. They are important to modern life and can be differed by electrolyte they used and operation temperature they are run under. Among them, solid oxide fuel cell is one of the most important one for its high efficiency with heat recovering system on using un-reacted fuel and high-temperature tail gas.

Within a solid oxide fuel cell, a fuel and an oxidant (air or oxygen) enter into a cathode and an anode of the solid oxide fuel cell while they are pre-heated to a temperature around 600° C. to 1000° C., which is an operational temperature for the solid oxide fuel cell. Regarding the fuel, not only hydrogen gas is usually used, but also a reformer can be used where hydrocarbon fuel is transformed into a hydrogen-rich fuel to be used in the solid oxide fuel cell.

On using a fuel cell, owing to a limit of concentration polarization in electrochemical reaction, fuel in the fuel cell is not fully electrochemically reacted. The utilization rate of the fuel in the solid oxide fuel cell is about 60% to 85%. Therefore, at the outlet of the cell stack, about 15% to 40% of the inputted fuel is not electrochemically reacted before being discharged. The un-reacted fuel is usually handled through burning by a burning device at tail of the cell and the heat thus generated is recycled through a heat exchanger as a heat source for preheating the gases at the cathode/anode inlets of the cell stack.

There are three operational phases on using the fuel cell, including warming-up phase, steady-state phase and shut-down phase.

During warming up a fuel cell stack system, the system may be cracked owing to its different thermal expansion coefficients of stacked ceramic and metal components. Hence, the velocity for warming up the fuel cell is usually very slow, which may be 1° C. per minute. Yet, once a burning device is activated, the temperature may reach hundreds degrees in a few seconds. As long as the burning device and the heat exchanger are connected serially, the rapidly raised temperature will ruin the stack if no special control strategies take control of it. So, the heat output of the burning device usually has a wide range of turn down ratio, where 10 is a preferred value for 1 to 10 kilo-watts. In addition, as the temperature is getting higher, temperature of the gas output at the outlet of the stack is getting higher too. To avoid too high temperature for the burning device and to keep temperature steady at the outlet of the burning device, the fuel entered into the burning device must be greatly reduced. Because the temperature of the gas at the outlet of the cell stack may reach 600° C. to 1000° C. after warming up, an equivalent ratio (ψ) of the fuel have to be further reduced. For example, with a flow of a cooling gas, an equivalent ratio below 0.25 is even required for the cell stack having a 1000° C. gas at its outlet.

When the fuel cell generates power during the steady-state phase, fuel required for full-load operation is usually filled in and full load is accomplished by gradually increasing the utilization rate of the fuel. However, because the utilization rate of the cell stack is gradually increased, all fuel is entered into the burning device before having any electrochemical reaction as the utility rate is 0% in the fuel cell—which is the full load requirement of the burning device. Furthermore, since the gas at the outlet of the cell stack is as high as the temperature in the cell stack about 750° C., a cooling gas or a way for cooling down the gas at the inlet of the fuel cell is required.

During the shut-down phase, the system keeps cooling down gradually, so the operational conditions of the burning device are the same as those for the warming-up phase except the whole process are reversed.

For coordinating the operation of the high-temperature fuel cell and the gas at the outlet and further for the requirements of complete combustion and low pollution, the burning device needs to have a high turndown ratio and a wide operational equivalent ratio. Yet, the burning device traditionally uses combustion mode as free flame and so do not fulfill the requirements. Hence, a burning device having catalyst or porous medium is used.

Regarding the burning device having porous medium, as revealed in the patents of EP0657011A1, DE1303596B, ES2129659T3, U.S. Pat. No. 6,997,701B2, U.S. Pat. No. 4,746,286 and US2006035190A1, fuel and gas are mixed at first. Then, the mixed gas is passed through multi-layers of porous media, where there are more than two layers of porous medium. A former layer of the porous medium layers has smaller pore size to prevent burning reaction while latter layers of the porous medium layers have larger pore size for processing burning reaction with flameless combustion or so called excess enthalpy flame inside pores. Therein, the porous medium is made of aluminum oxide ($Al_2O_3$), carbon fiber reinforced silicon carbide (C/SiC), zirconium dioxide ($ZrO_2$) or a superalloy like an alloy of Fe—Cr—Al; and the porous medium has a form of fibers, particle bed or porous block. On using the high-temperature fuel cell, because the temperature at the outlet of the burning device is high above 600° C. and main component of the fuel is hydrogen gas (H2), flash back will happen on reaching the 574° C. flash point of H2 if the fuel is premixed with air at such a high temperature. As a result, operation of the burning device becomes unsafe due to unexpected free flame combustion in the gas premixed section. The pollutions of carbon monoxide and hydrocarbon compounds will also be produced owing to incomplete combustion with the free flame combustion mode in the burning device.

Consequently, if a burning device having porous medium is used in a fuel cell system with the above structure and technology, the gas entered into the burning device has to be cooled down at first. Yet, this adds complexity to the system and application of the burning device is limited. Hence, the prior arts do not fulfill all users' requests on actual use.

SUMMARY OF THE DISCLOSURE

The main purpose of the present disclosure is to provide a burning apparatus using porous medium for a high-temperature fuel cell system.

The second purpose of the present disclosure is to provide a burning apparatus with wide application and low pollution as a heat source for warming up the system during initiation or for burning residual fuel in tail gas of a fuel cell stack.

The third purpose of the present disclosure is to provide a burning apparatus running under various states of gas flow with wide operation range and low waste gas pollution.

The fourth purpose of the present disclosure is to provide a specific-designed fuel spraying device for a high-temperature fuel cell system.

To achieve the above purposes, the present disclosure is a porous-medium burning apparatus, comprising an oxidant inlet, a fuel spraying device, a buffer chamber, a gas rectifying panel, a combustion chamber, a tail gas outlet and an ignition plug, where the oxidant inlet guides an oxidant entered to burn a fuel; the fuel spraying device comprises a fuel inlet, a plurality of fuel spraying tube branches and a plurality of fuel spraying holes; the fuel spraying device guides the fuel entered from the fuel inlet and then the fuel is directly sprayed through the fuel spraying holes; each of the fuel spraying tube branches has a flat end surface with the fuel spraying holes located on; the buffer chamber connected with the oxidant inlet has a buffering space for spreading the oxidant received from the oxidant inlet; the gas rectifying panel connected with the buffer chamber has a plurality of pores for rectifying the oxidant; the gas rectifying panel has a rectifying space for uniformly distributing the oxidant through the pores; the combustion chamber connected with the rectifying space comprises a burning space and at least one porous medium; the at least one porous medium located in the burning space has pores of the same radius; the oxidant and the fuel are mixed in a former section of the at least one porous medium to process a burning reaction in the at least one porous medium other than the former section; the tail gas outlet is connected with the burning space to outlet a tail gas; the ignition plug is positioned on the combustion chamber to provide an ignition device; each end surface of the fuel spraying tube branches is directly adhered to an end surface of the at least one porous medium with no space left between the fuel spraying holes and the at least one porous medium to guide the fuel directly entered into the at least one porous medium; and, with the oxidant entered through the fuel spraying tube branches, small flow recirculation section are formed at each end surface of the fuel spraying tube branches to further enhance the gases mixing for more complete combustion. Accordingly, a novel porous-medium burning apparatus is obtained.

BRIEF DESCRIPTIONS OF THE DRAWINGS

Figure 2:
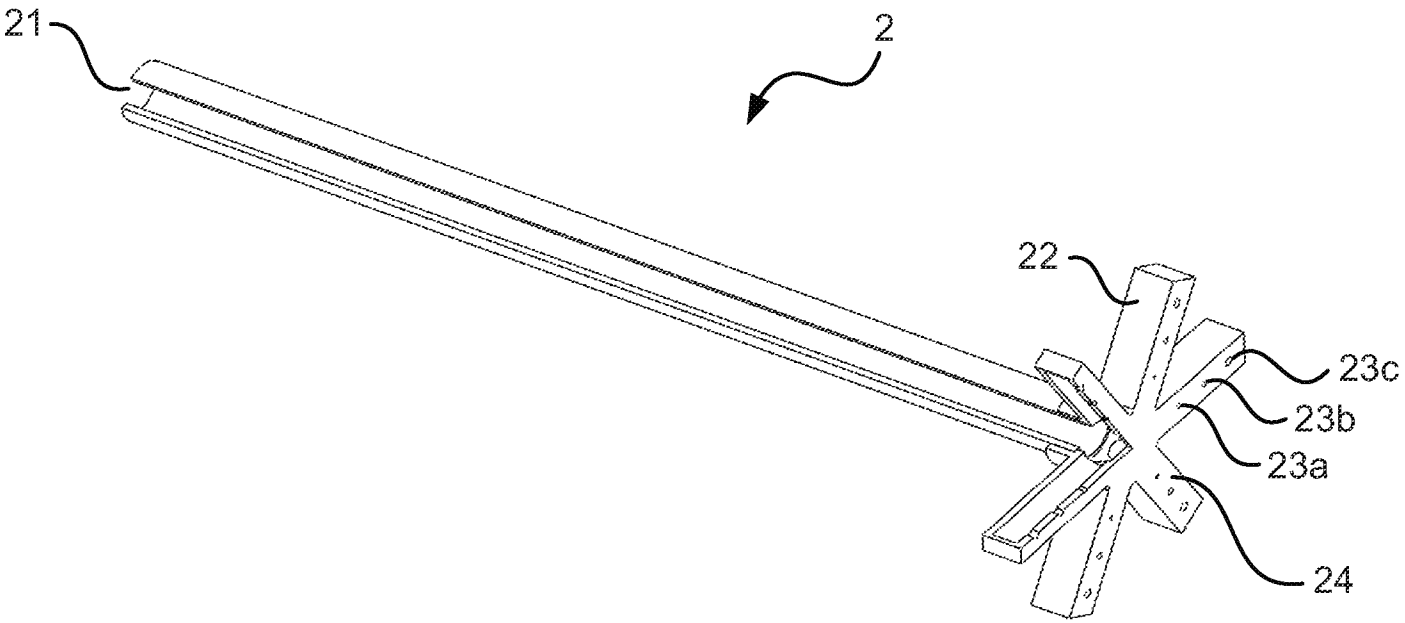

The present disclosure will be better understood from the following detailed description of the preferred embodiment according to the present disclosure, taken in conjunction with the accompanying drawings, in which FIG. 1 is the perspective view showing the preferred embodiment according to the present disclosure; and FIG. 2 is the perspective view showing the fuel spraying device.

DESCRIPTION OF THE PREFERRED EMBODIMENT

The following description of the preferred embodiment is provided to understand the features and the structures of the present disclosure.

Please refer to FIG. 1 and FIG. 2, which are perspective views showing a preferred embodiment and a fuel spraying device according to the present disclosure. As shown in the figures, the present disclosure is a porous-medium burning apparatus, where the burning apparatus is set in a fuel cell system to provide a heat source for activating the system or to burn residual fuel in a tail gas of a fuel cell stack. The burning apparatus comprises an oxidant inlet 1, a fuel spraying device 2, a buffer chamber 3, a gas rectifying panel 4, a combustion chamber 5, a tail gas outlet 6 and an ignition plug 7. The burning apparatus can be run under various states for improving system efficiency by enhancing recycling of system heat and for reducing pollution of discharged waste gas, where those states includes system initiating operation, steady-state operation, dynamic load operation and shut-down operation.

The oxidant inlet 1 guides an oxidant 11 entered as an oxygen-containing gas for burning a fuel 25, where the oxidant 11 is an oxygen-containing gas having a high temperature at a cathode side of a fuel cell stack; a gas having a normal temperature; a gas having a high temperature; or a gas formed by mixing the gas having a high temperature at the cathode side of the fuel cell stack and a gas having a low temperature from other sources.

The fuel spraying device 2 guides the fuel 25 entered through a fuel inlet 21 for burning the fuel 25, where the fuel 25 is a tail gas at an anode side of a fuel cell; or a gas formed by mixing the tail gas at the anode side of the fuel cell and a gas of natural gas, hydrogen gas, methane gas or propane gas.

The buffer chamber 3 is connected with the oxidant inlet 1 and has a buffering space 31 for receiving the oxidant 11 into the buffering space 31 from the oxidant inlet 1 to preliminarily spread the oxidant 11.

The gas rectifying panel 4, formed by drilling a plurality of pores on a metal material, is connected with the buffer chamber 3 for preliminarily rectifying gas. The gas rectifying panel 4 has a rectifying space 41 connected at a rear end and the rectifying space 41 can be further filled with ceramic balls or a porous medium for uniformly distributing the oxidant 11.

The combustion chamber 5 is connected with the rectifying space 41 at a rear direction and comprises a burning space 51 and porous media 52*a*~52*c*, where the porous media 52*a*~52*c* are put in the burning space and have pores of the same radius.

The tail gas outlet 6 is connected with the burning space 51 at a rear direction for outputting a tail gas 61 to other unit of the fuel cell system.

The ignition plug 7 is set on the combustion chamber 5 to provide a device for ignition.

Thus, a novel porous-medium burning apparatus is obtained.

On using the present disclosure, the oxidant 11 flows into the buffering space 31 through the oxidant inlet 1 to be preliminarily rectified through the gas rectifying panel 4 and to be further rectified through the ceramic balls or the porous medium (not shown in the figures) in the rectifying space 41 more uniformly. Then, the uniformly rectified oxidant 11 passed through the rectifying space 41 is entered into the porous media 52*a*~52*c*, where the porous media 52*a*~52*c* are made of aluminum oxide ($Al_2O_3$), carbon fiber reinforced silicon carbide (C/SiC), zirconium dioxide ($ZrO_2$) or an alloy of Fe—Cr—Al. Each of the porous media 52*a*~52*c* has pores of a single radius and has a length of 100 millimeters (mm); and the porous media 52*a*~52*c* can be directly combined into a single block of porous medium.

The fuel 25 is entered into the fuel spraying device 2 from the fuel inlet 21 and is directly sprayed into the porous medium 52*a* through the fuel spraying holes 23*a*~23*c*. The fuel spraying device 2 comprises the fuel inlet 21, a plurality of fuel spraying tube branches 22 and a plurality of fuel spraying holes 23*a*~23*c*. Each of the fuel spraying tube branches 22 has a flat end surface 24. The fuel spraying tube branches 22 are used to uniformly distribute the fuel 25 in the combustion chamber 5, where there are 6 branches and the number of the branches is adjustable according to sectional area of the combustion chamber 5. The fuel spraying holes 23*a*~23*c* have aperture sizes increased radially from a center of the fuel spraying tube branches 22 to help uniformly spraying the fuel 25 in the combustion chamber 5. Therein, each end surface 24 of the fuel spraying tube branches 22 is directly contacted with an end surface of the porous medium 52*a* with no space left between the fuel spraying holes 23*a*~23*c* and the porous medium 52*a*, so that the fuel 25 is directly sprayed into the porous medium 52*a* for avoiding free flame mode combustion. Furthermore, when the oxidant 11 is entered through the fuel spraying tube branches 21, flow recirculation zone are formed at the end surface 24 of each fuel spraying tube branches 21 to steadily burn the fuel 25 by fully mixing the oxidant 11 and the fuel 25.

In the end, the oxidant 11, flown from the rectifying space 41 into the porous medium 52*a*, and the fuel 25, directly sprayed from the fuel spraying holes 23*a*~23*c*, are mixed in former section of the porous media 52*a*~52*c* and then a burning reaction is processed in the porous media 52*a*~52*c* other than the former section. After the burning reaction, a tail gas 61 is output to other unit of the fuel cell system through the tail gas outlet 6. Therein, the ignition plug 7 is a spark plug for initial ignition in the burning apparatus.

Since the mixing of the fuel 25 and oxidant 11 is done in the porous media 52*a*~52*c*, there would be no free flame and no flash back during the mixing at high temperature. Hence, the present disclosure can not only be applied with a fuel having a high heating value but also a fuel having a low heating value with low pollution produced; and thus is fit to be used in a high-temperature fuel cell system.

To sum up, the present disclosure is a porous-medium burning apparatus, where the burning apparatus is used in a fuel cell system to provide a heat source for warming up a fuel cell system in initiation or to burning residual fuel in tail gas of a fuel cell stack; and the present disclosure can be run under different status for improving system efficiency by enhancing recycling of system heat and for reducing pollution of discharged waste gas.

The preferred embodiment herein disclosed is not intended to unnecessarily limit the scope of the disclosure. Therefore, simple modifications or variations belonging to the equivalent of the scope of the claims and the instructions disclosed herein for a patent are all within the scope of the present disclosure.

What is claimed is:

1. A porous-medium burning apparatus, comprising:

an oxidant inlet, said oxidant inlet guiding an oxidant entered to burn a fuel;

a fuel spraying device, said fuel spraying device comprising a fuel inlet, a plurality of fuel spraying tube branches and a plurality of fuel spraying holes, said fuel spraying device guiding said fuel entered from said fuel inlet and then directly sprayed through said plurality of fuel spraying holes, each of said fuel spraying tube branches having a flat end surface and said fuel spraying holes being located on said end surface;

a buffer chamber, said buffer chamber being connected with said oxidant inlet, said buffer chamber having a buffering space, said buffer chamber receiving said oxidant from said oxidant inlet and spreading said oxidant into said buffering space;

a gas rectifying panel, said gas rectifying panel being connected with said buffer chamber, said gas rectifying panel having a plurality of pores to rectify said oxidant, said gas rectifying panel having a rectifying space to uniformly distributing said oxidant in said rectifying space through said plurality of pores;

a combustion chamber, said combustion chamber being connected with said rectifying space, said combustion chamber comprising a burning space and at least one porous medium, said at least one porous medium being located in said burning space, said at least one porous medium having pores of the same radius, said oxidant, flown from said rectifying space into said at least one porous medium, and said fuel, directly sprayed from said fuel spraying holes, being mixed in a section of said at least one porous medium close to said rectifying space to process a burning reaction in said at least one porous medium other than said section;

wherein said at least one porous medium has a length of 100 millimeters (mm); and wherein said length is adjustable according to gas flow status;

a tail gas outlet, said tail gas outlet being connected with said burning space to outlet a tail gas; and an ignition plug, said ignition plug being positioned on said combustion chamber to provide an ignition device, each end surface of said fuel spraying tube branches being directly adhered to an end surface of said at least one porous medium with no space left between said fuel spraying holes and said at least one porous medium and said fuel being directly entered into said at least one porous medium, wherein, when said oxidant is entered through said fuel spraying tube branches, small flow recirculation zones are obtained at each end surface of said fuel spraying tube branches to steadily burn said fuel by fully mixing said oxidant and said fuel.

2. The apparatus according to claim 1, wherein said oxidant is selected from a group consisting of an oxygen-containing gas having a high temperature at a cathode side of a fuel cell stack, a gas having a normal temperature, a gas having a high temperature, a gas obtained by mixing said gas having a high temperature at said cathode side of said fuel cell stack, and a gas having a low temperature from other sources.

3. The apparatus according to claim 1, wherein said gas rectifying panel is obtained by drilling pores on a metal material.

4. The apparatus according to claim 1, wherein said rectifying space is further filled with a material selected from a group consisting of ceramic balls and at least one porous medium.

5. The apparatus according to claim 1, wherein said at least one porous medium is made of a material selected from a group consisting of aluminum oxide ($Al_2O_3$), carbon fiber reinforced silicon carbide (C/SiC), zirconium dioxide ($ZrO_2$) and an alloy of Fe—Cr—Al.

6. The apparatus according to claim 1, wherein said at least one porous medium comprises three sections of media.

7. The apparatus according to claim 6, wherein said at least one porous medium comprises a single section of medium.

8. The apparatus according to claim 1, wherein said fuel is selected from a group consisting of a tail gas at an anode side of a fuel cell, and a gas obtained by mixing said tail gas at said anode side of said fuel cell and an extra gas selected from a group consisting of natural gas, hydrogen gas, methane gas and propane gas.

9. The apparatus according to claim 1, wherein a quantity of said fuel spraying tube branches is 6; and wherein said quantity of said fuel spraying tube branches is adjustable according to sectional area of said combustion chamber.

10. The apparatus according to claim 1, wherein said fuel spraying holes have aperture sizes increased radially from a center of said fuel spraying tube branches.

11. The apparatus according to claim 1, wherein said ignition device is a spark plug.

12. The apparatus according to claim 1, wherein said fuel spraying tube branches coordinated with said fuel spraying holes uniformly spreads said fuel in said combustion chamber.

13. A porous-medium burning apparatus, comprising:

an oxidant inlet, said oxidant inlet guiding an oxidant entered to burn a fuel;

a fuel spraying device, said fuel spraying device comprising a fuel inlet, a plurality of fuel spraying tube branches and a plurality of fuel spraying holes, said fuel spraying device guiding said fuel entered from said fuel inlet and then directly sprayed through said plurality of fuel spraying holes, each of said fuel spraying tube branches having a flat end surface and said fuel spraying holes being located on said end surface;

a buffer chamber, said buffer chamber being connected with said oxidant inlet, said buffer chamber having a buffering space, said buffer chamber receiving said oxidant from said oxidant inlet and spreading said oxidant into said buffering space;

a gas rectifying panel, said gas rectifying panel being connected with said buffer chamber, said gas rectifying panel having a plurality of pores to rectify said oxidant, said gas rectifying panel having a rectifying space to uniformly distributing said oxidant in said rectifying space through said plurality of pores;

a combustion chamber, said combustion chamber being connected with said rectifying space, said combustion chamber comprising a burning space and at least one porous medium, said at least one porous medium being located in said burning space, said at least one porous medium having pores of the same radius, said oxidant, flown from said rectifying space into said at least one porous medium, and said fuel, directly sprayed from said fuel spraying holes, being mixed in a section of said at least one porous medium close to said rectifying space to process a burning reaction in said at least one porous medium other than said section;

wherein said at least one porous medium comprises three sections of media;

wherein said at least one porous medium comprises a single section of medium;

a tail gas outlet, said tail gas outlet being connected with said burning space to outlet a tail gas; and an ignition plug, said ignition plug being positioned on said combustion chamber to provide an ignition device, each end surface of said fuel spraying tube branches being directly adhered to an end surface of said at least one porous medium with no space left between said fuel spraying holes and said at least one porous medium and said fuel being directly entered into said at least one porous medium, wherein, when said oxidant is entered through said fuel spraying tube branches, small flow recirculation zones are obtained at each end surface of said fuel spraying tube branches to steadily burn said fuel by fully mixing said oxidant and said fuel.

14. A porous-medium burning apparatus, comprising:

an oxidant inlet, said oxidant inlet guiding an oxidant entered to burn a fuel;

a fuel spraying device, said fuel spraying device comprising a fuel inlet, a plurality of fuel spraying tube branches and a plurality of fuel spraying holes, said fuel spraying device guiding said fuel entered from said fuel inlet and then directly sprayed through said plurality of fuel spraying holes, each of said fuel spraying tube branches having a flat end surface and said fuel spraying holes being located on said end surface;

wherein a quantity of said fuel spraying tube branches is 6; and wherein said quantity of said fuel spraying tube branches is adjustable according to sectional area of said combustion chamber;

a buffer chamber, said buffer chamber being connected with said oxidant inlet, said buffer chamber having a buffering space, said buffer chamber receiving said oxidant from said oxidant inlet and spreading said oxidant into said buffering space;

a gas rectifying panel, said gas rectifying panel being connected with said buffer chamber, said gas rectifying panel having a plurality of pores to rectify said oxidant, said gas rectifying panel having a rectifying space to uniformly distributing said oxidant in said rectifying space through said plurality of pores;

a combustion chamber, said combustion chamber being connected with said rectifying space, said combustion chamber comprising a burning space and at least one porous medium, said at least one porous medium being located in said burning space, said at least one porous medium having pores of the same radius, said oxidant, flown from said rectifying space into said at least one porous medium, and said fuel, directly sprayed from said fuel spraying holes, being mixed in a section of said at least one porous medium close to said rectifying space to process a burning reaction in said at least one porous medium other than said section;

a tail gas outlet, said tail gas outlet being connected with said burning space to outlet a tail gas; and an ignition plug, said ignition plug being positioned on said combustion chamber to provide an ignition device, each end surface of said fuel spraying tube branches being directly adhered to an end surface of said at least one porous medium with no space left between said fuel spraying holes and said at least one porous medium and said fuel being directly entered into said at least one porous medium, wherein, when said oxidant is entered through said fuel spraying tube branches, small flow recirculation zones are obtained at each end surface of said fuel spraying tube branches to steadily burn said fuel by fully mixing said oxidant and said fuel.

15. A porous-medium burning apparatus, comprising:

an oxidant inlet, said oxidant inlet guiding an oxidant entered to burn a fuel;

a fuel spraying device, said fuel spraying device comprising a fuel inlet, a plurality of fuel spraying tube branches and a plurality of fuel spraying holes, said fuel spraying device guiding said fuel entered from said fuel inlet and then directly sprayed through said plurality of fuel spraying holes, each of said fuel spraying tube branches having a flat end surface and said fuel spraying holes being located on said end surface;

wherein said fuel spraying holes have aperture sizes increased radially from a center of said fuel spraying tube branches;

a buffer chamber, said buffer chamber being connected with said oxidant inlet, said buffer chamber having a buffering space, said buffer chamber receiving said oxidant from said oxidant inlet and spreading said oxidant into said buffering space;

a gas rectifying panel, said gas rectifying panel being connected with said buffer chamber, said gas rectifying panel having a plurality of pores to rectify said oxidant, said gas rectifying panel having a rectifying space to uniformly distributing said oxidant in said rectifying space through said plurality of pores;

a combustion chamber, said combustion chamber being connected with said rectifying space, said combustion chamber comprising a burning space and at least one porous medium, said at least one porous medium being located in said burning space, said at least one porous medium having pores of the same radius, said oxidant, flown from said rectifying space into said at least one porous medium, and said fuel, directly sprayed from said fuel spraying holes, being mixed in a section of said at least one porous medium close to said rectifying space to process a burning reaction in said at least one porous medium other than said section;

a tail gas outlet, said tail gas outlet being connected with said burning space to outlet a tail gas; and an ignition plug, said ignition plug being positioned on said combustion chamber to provide an ignition device, each end surface of said fuel spraying tube branches being directly adhered to an end surface of said at least one porous medium with no space left between said fuel spraying holes and said at least one porous medium and said fuel being directly entered into said at least one porous medium, wherein, when said oxidant is entered through said fuel spraying tube branches, small flow recirculation zones are obtained at each end surface of said fuel spraying tube branches to steadily burn said fuel by fully mixing said oxidant and said fuel.

* * * * *